US008842865B2

(12) United States Patent
Knieschewski

(10) Patent No.: US 8,842,865 B2
(45) Date of Patent: Sep. 23, 2014

(54) LOUDSPEAKER SYSTEM AND WAVESHAPING UNIT

(75) Inventor: Jörg Knieschewski, Garbsen (DE)

(73) Assignees: K+H Vertriebs-und Entwicklungsgesellschaft mbH, Wedemark (DE); Sennheiser Electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/380,134

(22) PCT Filed: Jun. 24, 2010

(86) PCT No.: PCT/EP2010/059004

§ 371 (c)(1),
(2), (4) Date: Jan. 12, 2012

(87) PCT Pub. No.: WO2010/149741

PCT Pub. Date: Dec. 29, 2010

(65) Prior Publication Data

US 2012/0106765 A1 May 3, 2012

(30) Foreign Application Priority Data

Jun. 25, 2009 (DE) ..... 10 2009 027 212

(51) Int. Cl.
*H04R 1/20* (2006.01)
*H04R 1/34* (2006.01)
*H04R 1/40* (2006.01)

(52) U.S. Cl.
CPC ..... *H04R 1/345* (2013.01); *H04R 1/403* (2013.01)
USPC ..... 381/337; 381/345

(58) Field of Classification Search
CPC ..... H04R 29/002; H04R 29/005; H04R 2201/401; H04R 2201/403; H04R 2201/405
USPC ..... 381/337–343, 345–354, 186, 386–387, 381/391–392, 395, 182, 335; 181/148–156, 181/159, 171, 175–205
See application file for complete search history.

(56) References Cited

U.S. PATENT DOCUMENTS

| | | | | |
|---|---|---|---|---|
| 4,629,029 | A | 12/1986 | Gunness | |
| 5,163,167 | A | 11/1992 | Heil | |
| 5,900,593 | A | 5/1999 | Adamson | |
| 7,634,100 | B2 * | 12/2009 | Monitto et al. | 381/386 |
| 7,760,899 | B1 * | 7/2010 | Graber | 381/341 |
| 2004/0245042 | A1 | 12/2004 | Nevill | |
| 2005/0265570 | A1 | 12/2005 | Isotalo | |
| 2008/0000714 | A1 * | 1/2008 | Adams | 181/148 |

FOREIGN PATENT DOCUMENTS

| | | |
|---|---|---|
| DE | 100 61 734 | 8/2002 |
| DE | 103 10 033 | 9/2004 |

OTHER PUBLICATIONS

International Search Report for Application No. PCT/EP2010/059004 dated Jul. 22, 2010.

* cited by examiner

*Primary Examiner* — Ahmad Matar
*Assistant Examiner* — Katherine Faley
(74) *Attorney, Agent, or Firm* — Frommer Lawrence & Haug LLP

(57) ABSTRACT

The invention concerns a loudspeaker system having a plurality of segmented line array speakers and a plurality of acoustic waveshapers. In addition there is provided an overlap region between two adjacent waveshapers.

5 Claims, 2 Drawing Sheets

State of the art

Detail A

LOUDSPEAKER SYSTEM AND WAVESHAPING UNIT

The present application claims priority from PCT Patent Application No. PCT/EP2010/059004 filed on Jun. 24, 2010, which claims priority from German Patent Application No. DE 10 2009 027 212.7 filed on Jun. 25, 2009, the disclosures of which are incorporated herein by reference in their entirety.

BACKGROUND OF THE INVENTION

1. Field of the Invention

The present invention concerns a loudspeaker system and a waveshaping unit.

2. Description of Related Art

Loudspeaker segments with segmented line array speakers and waveshapers (waveguides) are used in acoustic installations That permits sound propagation in the form of a cylindrical wave, which can reduce the propagation attenuation.

U.S. Pat. No. 5,900,593 shows a loudspeaker system with segmented line array speakers and waveshapers. The configuration of the waveshapers in particular at their transitions can however lead to interference.

U.S. Pat. No. 5,163,167 shows a loudspeaker system with waveguides. In that case various waveguides can be arranged one above or one beside the other. In this case also interference can occur in the transitional region between two waveguides.

As general state of the art attention is directed to the documents U.S. 2005/0265570 A1 and U.S. 2004/0245042 A1.

SUMMARY OF THE INVENTION

An object of the present invention is to provide a loudspeaker system having a plurality of line array speakers and waveshapers which have reduced susceptibility to interference.

Thus there is provided a loudspeaker system having a plurality of segmented line array speakers and a plurality of acoustic waveshapers. In addition there is provided at least one overlap region between two adjacent waveshapers.

In an aspect of the present invention the overlap region is achieved by the oppositely disposed ends of the waveshapers being of a beveled configuration.

In a further aspect of the invention the overlap region is achieved by the oppositely disposed ends of two waveshapers being of a stepped configuration and engaging into each other.

In a further aspect of the invention the overlap region is achieved by an end of a first waveshaper extending into a complementary end of the second waveshaper.

In a further aspect of the invention there is provided a waveshaper unit for a loudspeaker system having a plurality of segmented line array speakers. The waveshaper unit has at least two adjacent waveshapers and an overlap region between the at least two adjacent waveshapers.

The invention concerns the notion of providing an overlap region between two adjacent line array speakers or waveshapers. The provision of an overlap region between two adjacent waveshapers means that it is possible to permit a substantially constant quick acoustic behaviour. In addition interference which occurs by virtue of the transitions between adjacent line array speakers can be reduced by the provision of the overlap regions.

Further configurations of the invention are subject-matter of the appendant claims.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
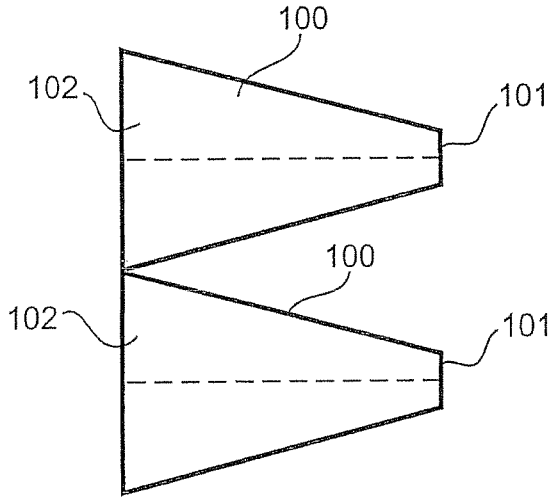
FIG. 1 shows a diagrammatic side view of a loudspeaker system according to the state of the art.

FIG. 1 shows a diagrammatic side view of a loudspeaker system according to the state of the art. In this case two adjacent segmented line array speakers 100 or the acoustic waveshaper of the line array speaker are shown. The waveshaper 200 has first and second ends 101 and 102. A loudspeaker is provided at the first ends 101. That loudspeaker produces for example a spherical wave which is converted into a plane wave in the waveshapers 100.

Figure 2:
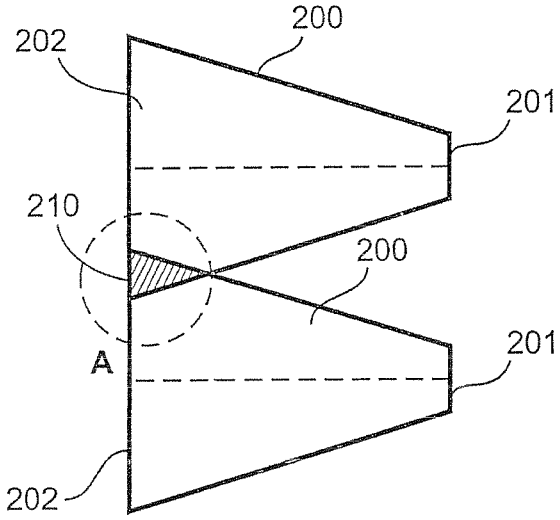
FIG. 2 shows a diagrammatic side view of a loudspeaker system according to a first embodiment.

FIG. 2 shows a diagrammatic sectional view of a loudspeaker system according to a first embodiment. The loudspeaker system has segmented line array speakers with acoustic waveshapers 200. The acoustic waveshapers 200 have first and second ends 201, 202. A loudspeaker is provided at the first end 201. The loudspeaker produces for example a spherical wave which is converted into a plane wave in the waveshapers 200. In the first embodiment two adjacent waveshapers 200 have an overlap region 210. In other words the housings of the waveshapers have an overlap portion or a superimposition portion.

Figure 3:
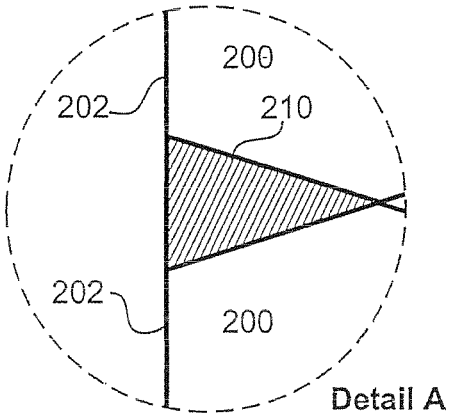
FIG. 3 shows a portion on an enlarged scale of FIG. 2 according to the first embodiment.

FIG. 3 shows a view on an enlarged scale of a portion of the loudspeaker system of FIG. 2. The overlap region 210 is shown on a larger scale here. While in the loudspeaker system in accordance with the state of the art in FIG. 1 there is no overlap of the waveshapers, the first embodiment is distinguished in that there is such an overlap region.

Figure 4A:
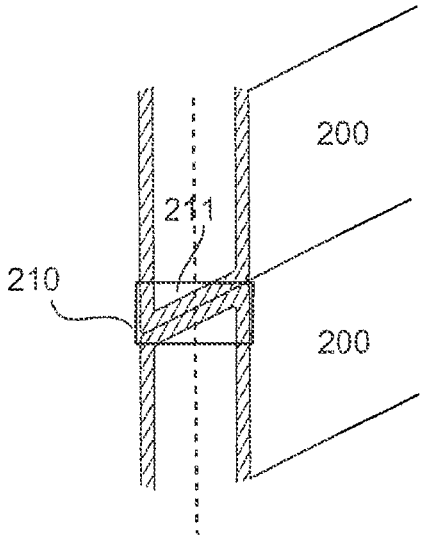
FIG. 4A shows a perspective view of a portion of a loudspeaker system according to a second embodiment.

FIG. 4A shows a perspective view of a part of a loudspeaker system according to a second embodiment. Here the overlap region 210 is of such a configuration that the adjacent waveshapers 200 are of an inclined configuration 211 or are cut off inclinedly at their oppositely disposed ends.

Figure 4B:
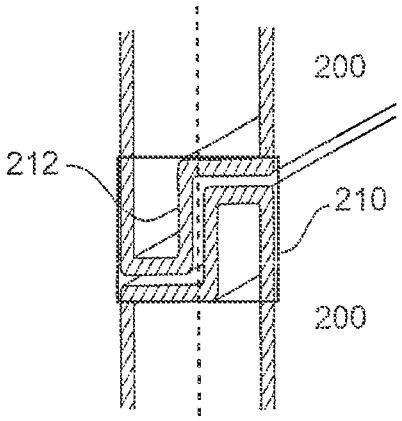
FIG. 4B shows a perspective view of a portion of a loudspeaker system according to a third embodiment.

FIG. 4B shows a perspective of a part of a loudspeaker according to the third embodiment. Here the third embodiment is based on the first embodiment. The overlap region is of a stepped configuration 212 in accordance with the third embodiment.

Figure 4C:
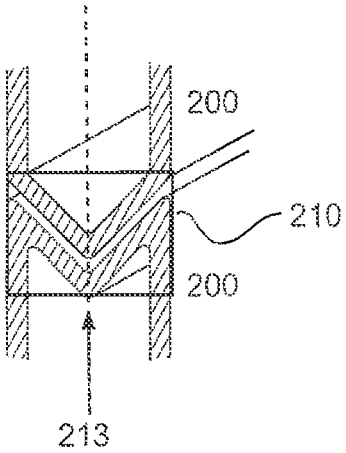
FIG. 4C shows a perspective view of a portion of a loudspeaker system according to a fourth embodiment.

FIG. 4C shows a perspective of a part of a loudspeaker according to a fourth embodiment. In this case the loudspeaker system according to the fourth embodiment is based on the loudspeaker system according to the first embodiment. The overlap region 210 is of such a configuration 213 that an end is in the form of an arrow tip and the adjacent waveshaper has an end of a corresponding configuration for receiving the arrow-shaped end.

The loudspeaker system according to the invention can have a multiplicity of segmented line array speakers.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defamed in the following claims.

The invention claimed is:

1. A loudspeaker system comprising:

a plurality of array speakers, wherein each segmented line array speaker comprises a loudspeaker and an acoustic waveshaper;

wherein each acoustic waveshaper has a first end and a second end;

wherein a each loudspeaker is provided at each of the first ends, each loudspeaker producing an acoustic wave which is converted in the waveshaper;

wherein a cross section of the first end of each waveshaper is smaller than a cross section of the second end of each waveshaper;

wherein each waveshaper is configured to convert a spherical wave from the loudspeaker at its first end into a plane wave at its second end;

wherein the plane wave comprises a top side, a bottom side, and two sides that connect the top side and the bottom side, wherein at least one side of the second end of each waveshaper comprises a sidewall that directly abuts a sidewall of an adjacent waveshaper; wherein at least one of the top side and the bottom side of the plane wave runs parallel to the abutting sidewalls of the adjacent waveshapers; and wherein a lateral axis of the plane wave extends through both of the abutting sidewalk of the adjacent waveshapers and the abutting sidewalls overlap and extend above and below the lateral axis to create an overlap region.

2. The loudspeaker system as set forth in claim 1;

wherein the overlap region is achieved by mutually opposite ends of the at least two acoustic waveshapers having a bevelled configuration.

3. The loudspeaker system as set forth in claim 1;

wherein, the overlap region is achieved by mutually opposite ends of the at least two acoustic waveshapers having a stepped configuration.

4. The loudspeaker system as set forth in claim 1;

wherein the overlap region is configured so that a first end of a first waveshaper of the at least two acoustic waveshapers extends into a second end of a second waveshaper of the at least two acoustic waveshapers.

5. A waveshaper unit for a loudspeaker system comprising:

at least two adjacent waveshapers, each having a first end and a second end, where each first end is adapted to be connected to a loudspeaker; and wherein a cross section of a first end of the waveshapers is smaller than a cross section of a second end of the waveshapers;

wherein the each waveshaper is configured to convert a spherical wave from the loudspeaker at its first end into a plane wave at its second end;

wherein the plane wave comprises a top side, a bottom side and two sides that connect the top side and the bottom side and wherein at least one side of the second end of each waveshaper comprises a sidewall that directly abuts a sidewall of an adjacent waveshaper wherein at least one of the top side and the bottom side of the plane wave runs parallel to the abutting sidewalls of the adjacent waveshapers; and wherein a lateral axis of the plane wave extends through both of the abutting sidewalls of the adjacent waveshapers and the abutting sidewalls overlap and extend above and below the lateral axis to create an overlap region.

* * * * *